US009664388B2

(12) United States Patent
Morita

(10) Patent No.: US 9,664,388 B2
(45) Date of Patent: May 30, 2017

(54) GLOW PLUG AND METHOD FOR MANUFACTURING GLOW PLUG

(75) Inventor: Kazuto Morita, Iwakura (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 185 days.

(21) Appl. No.: 14/119,603

(22) PCT Filed: May 22, 2012

(86) PCT No.: PCT/JP2012/003350

§ 371 (c)(1),
(2), (4) Date: Nov. 22, 2013

(87) PCT Pub. No.: WO2012/160816

PCT Pub. Date: Nov. 29, 2012

(65) Prior Publication Data

US 2014/0090618 A1 Apr. 3, 2014

(30) Foreign Application Priority Data

May 25, 2011 (JP) ..... 2011-116831
May 25, 2011 (JP) ..... 2011-116832

(51) Int. Cl.
*F23Q 7/00* (2006.01)
*H05B 3/48* (2006.01)

(52) U.S. Cl.
CPC ..... *F23Q 7/001* (2013.01); *H05B 3/48* (2013.01); *H05B 2203/027* (2013.01); *Y10T 29/49083* (2015.01)

(58) Field of Classification Search
CPC ..... F23Q 7/001; F23Q 2007/002; F23Q 2007/004; H05B 3/48; H05B 2203/027; Y10T 29/49083
See application file for complete search history.

(56) References Cited

U.S. PATENT DOCUMENTS 3,234,633 A 2/1966 Baxter
3,252,122 A * 5/1966 Baxter ..... H05B 3/48 123/145 R (Continued)

FOREIGN PATENT DOCUMENTS

EP 0229677 A2 7/1987
JP 54065227 A 5/1979

(Continued)

OTHER PUBLICATIONS

Search Report dated Oct. 2, 2014, issued by the European Patent Office in counterpart European Application No. 12790308.6.

(Continued)

*Primary Examiner* — Jacob Amick
(74) *Attorney, Agent, or Firm* — Sughrue Mion, PLLC

(57) ABSTRACT

A glow plug including a metal sheath tube having a closed front end; a heating element accommodated within the sheath tube; insulating powder filling the interior of the sheath tube so as to surround the heating element; a rod-shaped metal lead connected to the heating element and inserted into the sheath tube from the rear end thereof; and a seal member located in a seal portion at the rear end of the sheath tube to hermetically seal the gap between the sheath tube and the lead. The glow plug is characterized in that the sheath tube is formed to have a substantially uniform outer diameter over an axial range including and extending beyond a range where the seal portion is formed, and the sheath tube has an engagement projection formed at the seal portion and deformed so as to protrude radially inwardly.

11 Claims, 11 Drawing Sheets

(56) References Cited

U.S. PATENT DOCUMENTS

| | | | | | |
|---|---|---|---|---|---|
| 3,476,916 | A | | 11/1969 | La Van | |
| 4,200,077 | A | | 4/1980 | Kauhl et al. | |
| 4,477,717 | A | * | 10/1984 | Walton | 219/267 |
| 4,592,134 | A | | 6/1986 | Walton | |
| 6,064,039 | A | * | 5/2000 | Kumada | 219/270 |
| 2009/0090705 | A1 | | 4/2009 | Okumura et al. | |

FOREIGN PATENT DOCUMENTS

| | | | |
|---|---|---|---|
| JP | 5009698 | B2 | 2/1993 |
| JP | 2003133035 | A | 5/2003 |
| JP | 2009092291 | A | 4/2009 |
| JP | 2010-164242 | A | 7/2010 |
| JP | 2010159936 | A | 7/2010 |
| JP | 2010249354 | A | 11/2010 |

OTHER PUBLICATIONS

International Search Report (PCT/ISA/210) issued Jul. 3, 2012, in corresponding Internation Application No. PCT/JP2012/003350.
Written Opinion (PCT/ISA/237) issued Jul. 3, 2012, in corresponding Internation Application No. PCT/JP2012/003350.

* cited by examiner

GLOW PLUG AND METHOD FOR MANUFACTURING GLOW PLUG

CROSS-REFERENCE TO RELATED APPLICATIONS

This is a National Stage of International Application No. PCT/JP2012/003350 filed May 22, 2012, claiming priority based on Japanese Patent Application No. 2011-116831 filed May 25, 2011 and Japanese Patent Application No. 2011-116832 filed May 25, 2011, the contents of all of which are incorporated herein by reference in their entirety.

TECHNICAL FIELD

The present invention relates to a glow plug for pre-heating a diesel engine and to a method for manufacturing the glow plug.

BACKGROUND ART

A conventional glow plug for a diesel engine will be described with reference to FIG. 9.

As is well-known, the glow plug 101 is used to, for example, pre-heat a diesel engine and includes a sheath heater 102 and a tubular metallic shell 103 that surrounds the radially outer side of the sheath heater 102.

The sheath heater 102 includes a metal sheath tube 104; a heating element 105 disposed inside the sheath tube 104; insulating powder 106 that fills the interior of the sheath tube 104 so as to surround the heating element 105; a rod-shaped lead 107 inserted into the sheath tube 104 from its rear end and having a front end connected a rear end portion 105*r* of the heating element 105; and a seal member 108 formed of, for example, silicon rubber and positioned within a seal portion 104*a* at the rear end of the sheath tube 104 to hermetically seal the gap between the sheath tube 104 and the lead 107.

In the sheath heater 102, after the heating element 105 and the lead 107 are disposed in the sheath tube 104 and the sheath tube 104 is filled with the insulating powder 106, the seal member 108 is attached to the seal portion 104*a*, and then the sheath tube 104 is swaged to have a predetermined reduced diameter (see Patent Document 1).

PRIOR ART DOCUMENT

Patent Document

Patent Document 1: Japanese Patent Application Laid-Open (kokai) No. 2003-133035 (paragraph 0019, FIG. 2)

SUMMARY OF THE INVENTION

Problems to be Solved by the Invention

In the seal portion 104*a* of the conventional sheath tube 104, a portion of the seal member 108 fitted into the seal portion 104*a* has a substantially straight cylindrical shape as shown in an enlarged view in FIG. 9, and this limits the seal performance. In addition, the seal member 108 may move in a coming-off direction. In such a case, the seal performance deteriorates. Low seal performance of the seal portion 104*a* causes water or oil to easily enter the sheath tube 104. If water or oil enters the sheath tube 104, problems such as expansion of the sheath tube 104 and formation of a short circuit due to oil (hereinafter referred to as an "oil short circuit") may occur upon energization.

The present invention has been made in view of the above circumstances, and an object of the invention is to provide a glow plug in which a seal member exhibits excellent seal performance and is less likely to come off. Another object of the invention is to provide a method for manufacturing the glow plug.

Means for Solving the Problems

In order to achieve the above-described object, the present invention provide a glow plug comprising:

a sheath tube which is formed of a metal and which extends in an axial direction and has a closed front end;

a heating element accommodated within the sheath tube;

insulating powder which fills an interior of the sheath tube so as to surround the heating element;

a rod-shaped lead which is formed of a metal and which is connected to the heating element and inserted into the sheath tube from a rear end of the sheath tube; and a seal member which is located in a seal portion of the sheath tube formed at the rear end of the sheath tube and which hermetically seals a gap between the sheath tube and the lead;

the glow plug being characterized in that the sheath tube is formed to have a substantially uniform outer diameter over an axial range including and extending beyond a range where the seal portion is formed, and the sheath tube has an engagement projection formed at the seal portion and deformed so as to protrude radially inwardly.

As recited in claim 2, the present invention provides a glow plug according to claim 1, wherein at least one of an outer diameter $\phi A$ of a rear portion of the seal member located rearward of a position where the engagement projection of the sheath tube is formed and an outer diameter $\phi C$ of a front portion of the seal member located frontward of the position is larger than an outer diameter $\phi B$ of the seal member at the position.

As recited in claim 3, the present invention provides a glow plug according to claim 2, wherein a difference between the outer diameter $\phi C$ of the front portion and the outer diameter $\phi B$ of the seal member at the position where the engagement projection is formed is 0.1 mm or larger.

As recited in claim 4, the present invention provides a method for manufacturing a glow plug including a sheath tube which is formed of a metal and which extends in an axial direction and has a closed front end;

a heating element accommodated within the sheath tube;

insulating powder which fills an interior of the sheath tube so as to surround the heating element;

a rod-shaped lead which is formed of a metal and which is connected to the heating element and inserted into the sheath tube from a rear end of the sheath tube; and a seal member which is located in a seal portion of the sheath tube formed at the rear end of the sheath tube and which hermetically seals a gap between the sheath tube and the lead;

the method being characterized in that the sheath tube has a thick-walled portion provided as a part of the seal portion and having a thickness larger than a thickness of the entire seal portion; and after the heating element, the lead, and the insulating powder are placed in the sheath tube, the seal member is disposed in the seal portion, and the seal portion is deformed by a force applied to an outer circumference of the seal portion, whereby the thick-walled portion forms an engagement projection that is deformed so as to protrude radially inwardly.

As recited in claim 5, the present invention provides a method for manufacturing a glow plug according to claim 4, wherein the thick-walled portion protrudes from the outer circumference of the seal portion.

As recited in claim 6, the present invention provides a method for manufacturing a glow plug according to claim 4 or 5, wherein the thick-walled portion is formed at a rear axial end of the seal portion.

As recited in claim 7, the present invention provides a method for manufacturing a glow plug according to any one of claims 4 to 6, wherein the sheath tube is formed by at least:

a preform forming step of forming a tube preform having a cylindrical tubular main portion and an enlarged-diameter portion which is located rearward of the main portion, has a diameter larger than an outer diameter of a rear end of the main portion, and is radially expanded; and a shearing step of separating and removing the enlarged-diameter portion by a shearing force by inserting the main portion of the tube preform into a shearing hole of a die, the shearing hole having an inner diameter at least equal to or larger than the outer diameter of the main portion, such that the enlarged-diameter portion is supported by a rear end of the shearing hole of the die, and moving a punch disposed radially inward of the enlarged-diameter portion toward the die coaxially with the shearing hole in order to produce the shearing force; and wherein the thick-walled portion of the sheath tube is a remaining portion of the enlarged-diameter portion remaining after the shearing step.

As recited in claim 8, the present invention provides a method for manufacturing a glow plug according to claim 7, wherein the enlarged-diameter portion is separated and removed in the shearing step in a region where the diameter of the enlarged-diameter portion gradually increases rearward from the main portion.

As recited in claim 9, the present invention provides a method for manufacturing a glow plug according to claim 7 or 8, wherein the enlarged-diameter portion is formed by plastic working.

As recited in claim 10, the present invention provides a method for manufacturing a glow plug according to any one of claims 7 to 9, wherein the main portion and the enlarged-diameter portion of the tube preform are formed from a plate-shaped metal material by deep-drawing.

As recited in claim 11, the present invention provides a method for manufacturing a glow plug according to any one of claims 7 to 10, wherein the tube preform for the sheath tube has a through-hole formed at a front end of the tube preform before welding of the heating element, and the through-hole is closed by welding of the heating element, and the method further comprises a hole forming step of, during the preform forming step or after the preform forming step, forming the through-hall by punching.

Advantageous of the Invention

In the present invention, the seal portion of the sheath tube has the engagement projection deformed so as to protrude radially inwardly, and the engagement projection tightens the seal member, so that seal performance is improved. Therefore, water or oil ingress into the sheath tube can be prevented, so that expansion of the sheath tube, the occurrence of an oil short circuit, etc. due to the water or oil ingress can be suppressed. In addition, movement of the seal member in a coming-off direction can be prevented. The seal portion is formed to have a substantially uniform outer diameter. This configuration, coupled with provision of the engagement projection, is expected to provide the effect of improving sealing performance, the effect of enhancing easiness of press-fitting, the effect of facilitating diameter reducing work, etc. The phrase "substantially uniform" does not mean that the outer diameter is strictly uniform. For example, during production of the glow plug, the seal portion is reduced in diameter by swaging. In this case, the seal portion may have an outer circumferential surface with a small inclination, i.e., have a slightly tapered shape. However, in the present invention, the phrase "substantially uniform" encompasses a case where the seal portion has a variation in diameter. For example, the variation in diameter may be 10/100 mm or less.

The engagement projection may be formed at any position so long as it is present in the seal portion where the seal member is disposed. In other words, it is sufficient that the seal member be pressed and deformed by the engagement projection so that the pressed and deformed portion of the seal member has the smallest outer diameter.

Claim 2 defines that the seal member is in a state in which at least one of the outer diameter $\phi A$ of the rear portion of the seal member located rearward of the position where the engagement projection of the sheath tube is formed and the outer diameter $\phi C$ of the front portion of the seal member located frontward of that position is larger than the outer diameter $\phi B$ of the seal member at that position. More preferably, the seal member is brought into a state in which both the outer diameter $\phi C$ of the front portion located frontward of that position and the outer diameter $\phi A$ of the rear portion located rearward of that position are larger than the outer diameter $\phi B$ of the seal member at that position, i.e., the seal member is constricted in the middle by the engagement projection. This is because excellent seal performance is achieved and the effect of preventing the seal member from moving in the coming-off direction is high.

In claim 3, the difference ($\phi C-\phi B$) between the outer diameter $\phi C$ of the front portion and the outer diameter $\phi B$ of the seal member at the position where the engagement projection is formed is set to be 0.1 mm or larger ($\phi C-\phi B \geq 0.1$ mm), so that excellent seal performance can be achieved. In order to prevent formation of a short circuit between the sheath tube and the lead, the outer diameter $\phi D$ of the lead at a position where the seal member is disposed is preferably determined such that the difference between $\phi C$ and $\phi B$ ($\phi C-\phi B$ (unit: mm)) is smaller than a value obtained by subtracting 1 mm from the difference between the outer diameter $\phi C$ of the front portion and the outer diameter $\phi D$ of the lead at the position where the seal member is disposed ($(\phi C-\phi D)-1$ (unit: mm)) (i.e., $\phi C-\phi B<(\phi C-\phi D)-1$ (unit: mm)).

The manufacturing method according to claim 4 has the effect of allowing simple and reliable formation of the engagement projection. From the viewpoint of simple formation of the engagement projection, it is preferable to form the thick-walled portion such that it protrudes from the outer circumference of the seal portion, as in the manufacturing method in claim 5. Paradoxically, the inner circumferential surface may have a uniform inner diameter over the entire region of the seal portion in the axial direction. More specifically, it is not necessary to form the engagement projection on the inner circumferential surface in advance, and the engagement projection may be formed only on the outer circumferential surface. This configuration is expected to provide an additional effect of avoiding a problem in that when the seal member is inserted into the sheath tube, the seal member is caught by the engagement projection and the insertion becomes difficult.

As described above, it is preferable that the seal member pressed by the engagement projection has a constricted shape. However, from a manufacturing point of view, it is preferable that the thick-walled portion is formed at the rear end of the sheath tube (seal portion) so that the engagement projection is formed at the rear end (claim 6). To form the thick-walled portion, any of various working methods can be used. When the thick-walled portion is formed at the rear end of the sheath tube, the rear end may be subjected to plastic working or may be heated and melted to form a thick-walled molten portion. In either case, since the end portion is subjected to working, the working can be performed easily.

Cutting performed during manufacture of the sheath heater produces chips which may cause a short circuit failure during use. Therefore, it is contemplated to use shearing instead of cutting. When shearing is used, the thick-walled portion that later becomes the engagement projection is formed during shearing. In this case, the short circuit failure described above can be avoided, and a glow plug in which the seal member is unlikely to come off can be efficiently manufactured. More specifically, an enlarged-diameter portion is formed at the rear end of a tube preform, and then the enlarged-diameter portion is separated and removed by a shearing force produced between a die and a punch (claim 7). In this case, the amount of chips generated is much smaller than that in a step of removing the unnecessary portion by cutting using a cutting tool or by grinding using a grindstone. The enlarged-diameter portion is supported externally by the die, and the shearing punch disposed inwardly of the enlarged-diameter portion slides coaxially with the shearing hole of the die to shear the enlarged-diameter portion, so that the risk of ingress of chips into the sheath tube is reduced. Since it is unnecessary to worry about remaining chips that may cause formation of a short circuit, no step for removing chips and no inspection are necessary, and a highly reliable glow plug can be provided. In addition, in contrast to the case in which cutting is performed in a radial direction, the sheared surface of the cylindrical tubular portion from which the enlarged-diameter portion has been separated and removed can have an axially extending mark formed uniformly in a circumferential direction. This provides an additional effect in which circumferential unevenness is unlikely to occur when that portion is subjected to working in a subsequent step. The enlarged-diameter portion is not limited to a portion expanded in the radial direction orthogonal to the axial direction into a collar shape. The enlarged-diameter portion may have a shape increased in diameter toward its front or rear end or a shape obtained by combining these shapes.

In the manufacturing method according to claim 8, the position at which the enlarged-diameter portion is separated and removed by shearing is limited to a position within a region where the diameter gradually increases rearward from the cylindrical tubular portion. This allows the shearing to be performed using a die and a punch with no excessive force. Therefore, it can be expected to obtain a clean sheared surface and long life of the jigs and tools.

To form the enlarged-diameter portion, plastic working can be used (claim 9). More specifically, deep-drawing can be used (claim 10). Only the enlarged-diameter portion may be formed using any of the above working methods, or the entire portion including the cylindrical tubular portion may be formed using any of the above working methods. Desirably, at least a portion of the cylindrical tubular portion that extends from the enlarged-diameter portion is subjected to working together with the enlarged-diameter portion in a single step. In this manner, both the formation of the enlarged-diameter portion and the formation of the cylindrical tubular portion can be easily achieved simultaneously.

The effect of the manufacturing method according to claim 11 is that no step for removing chips and no inspection are necessary even in the case in which the through hole to which the heating element is welded is provided.

MODES FOR CARRYING OUT THE INVENTION

An embodiment of the present invention will next be described with reference to the drawings.

Figure 1:
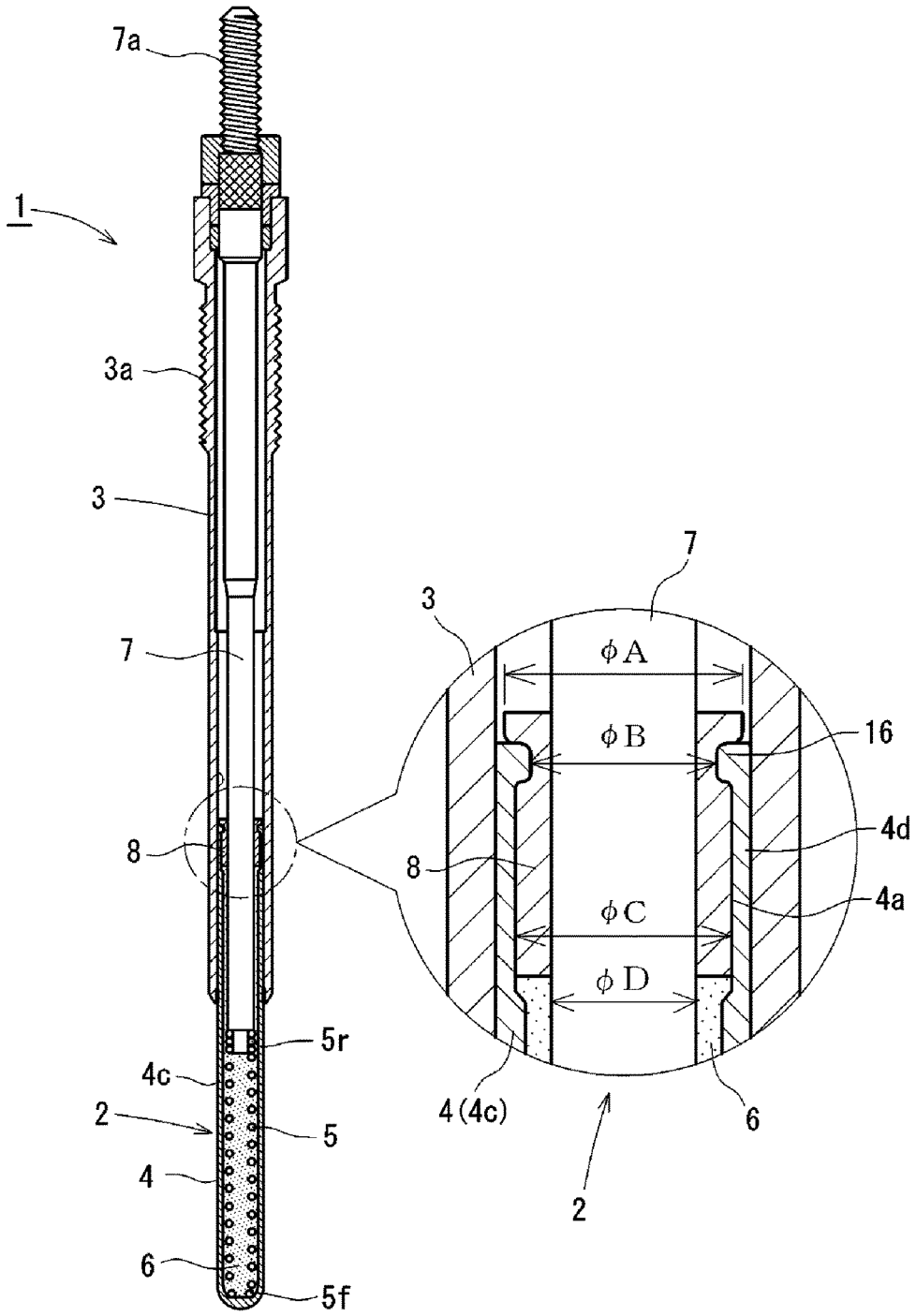
FIG. 1 A vertical cross-sectional view of a glow plug.

A glow plug 1 shown in FIG. 1 is used to pre-heat a diesel engine and includes a sheath heater 2 and a tubular metallic shell 3 that surrounds the radially outer side of the sheath heater 2. To attach the glow plug 1 to a diesel engine, a male thread portion 3*a* formed on the metallic shell 3 is screwed into an attachment hole (not shown) of the engine. In addition, a power cable (not shown) is connected to a thread shaft 7*a* protruding from the rear end of the metallic shell 3.

[Sheath Heater]

The sheath heater 2 includes a sheath tube 4 made of a metal (such as a stainless steel alloy, a nickel alloy, or Inconel), a heating element 5 disposed inside the sheath tube 4, insulating powder 6 (e.g., MgO powder) that fills the interior of the sheath tube 4 so as to surround the heating element 5, a rod-shaped lead 7 inserted into the sheath tube 4 from its rear end and having a front end to which a rear end 5*r* of the heating element 5 is connected, and a seal member 8 made of, for example, silicon rubber and located at a seal portion 4*a* of the sheath tube 4 which is located on the inner side of a rear end portion of the sheath tube 4. The seal member 8 hermetically seals the gap between the seal portion 4*a* and the lead 7. The heating element 5 is a resistance wire coil and includes a front end portion 5*f* welded to the front end of the sheath tube 4 and the rear end 5*r* connected to the front end of the lead 7.

[Sheath Tube]

Figure 5:
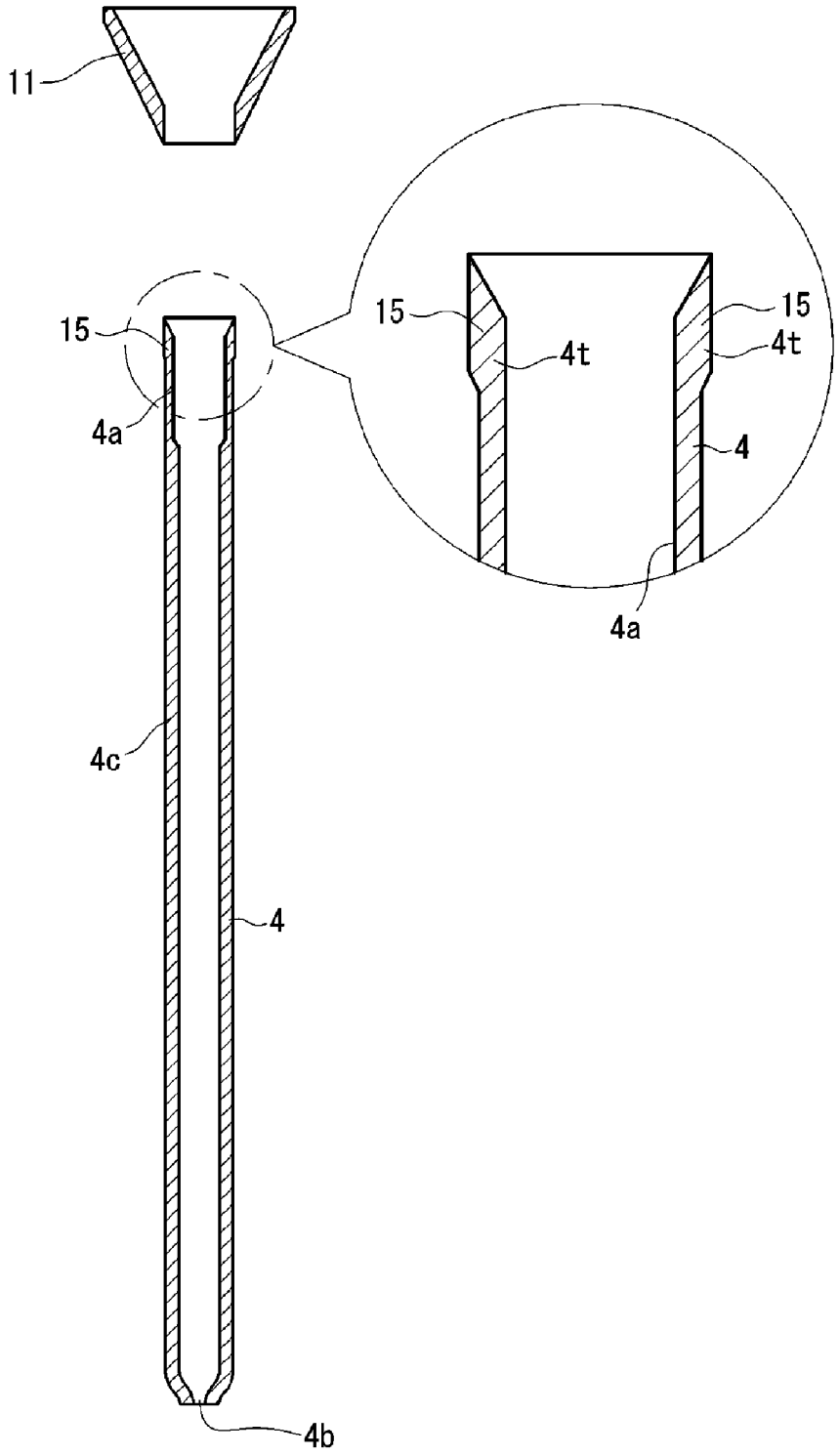
FIG. 5 A vertical cross-sectional view illustrating the sheath tube with the enlarged-diameter portion separated and removed.

Before welding of the heating element 5, the sheath tube 4 has the shape of a tube extending in an axial direction and having an open rear end and a through hole 4*b* at the front end, as shown in FIG. 5. After welding of the heating element 5, the sheath tube 4 has a tubular shape in which the through hole 4*b* is closed, i.e., the front end is closed, as shown in FIGS. 6(*a*) and 6(*b*).

Figure 6:
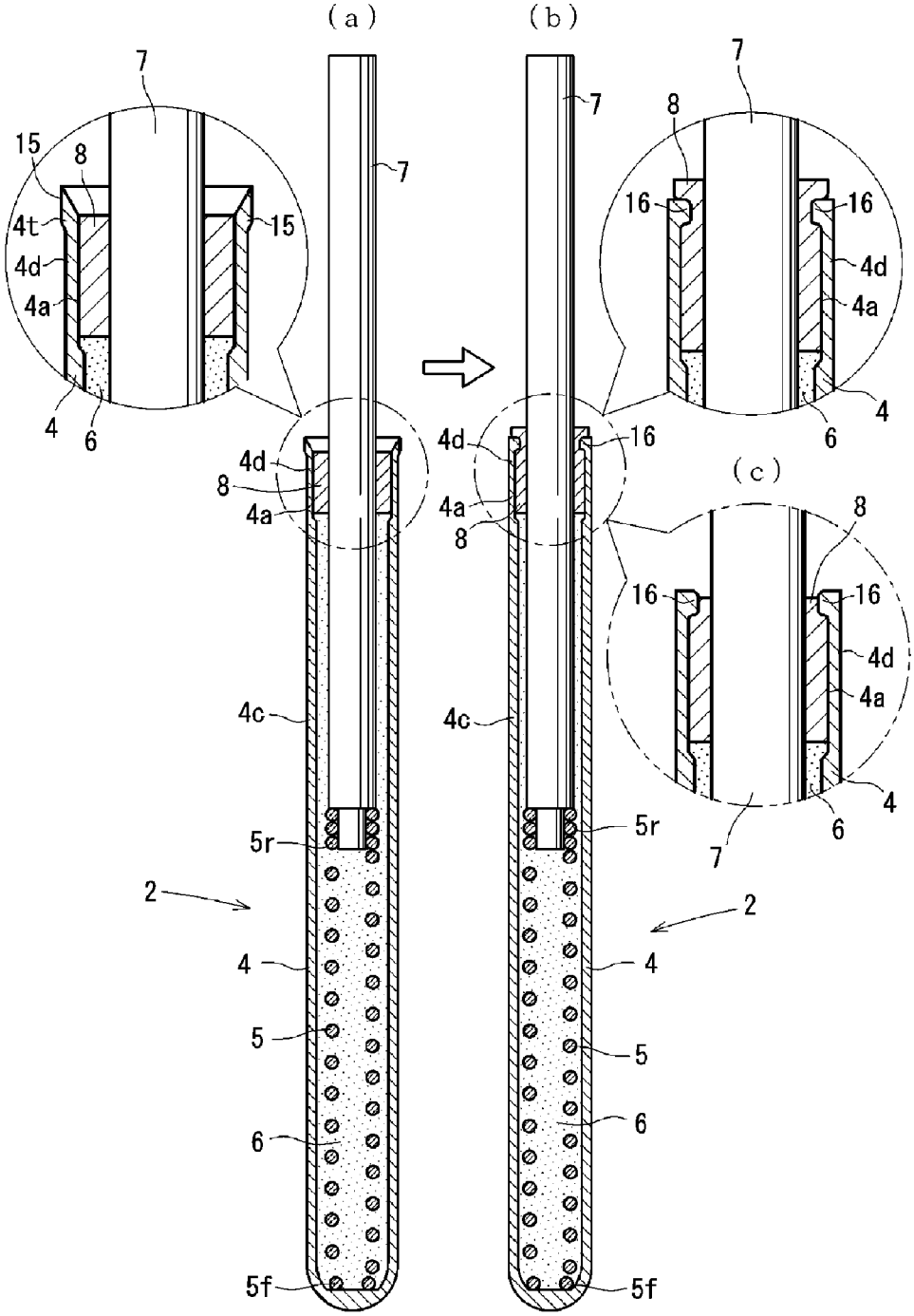
FIGS. 6(*a*) to 6(*c*) FIG. 6(*a*) being a vertical cross-sectional view illustrating the sheath heater before swaging, FIG. 6(*b*) being a vertical cross-sectional view of the sheath heater after swaging, and FIG. 6(*c*) being an enlarged view showing another embodiment.

As shown in FIGS. 1 and 6(*b*), the sheath tube 4 has an engagement projection 16 formed at the seal portion 4*a* and deformed so as to protrude radially inwardly.

[Method for Manufacturing Sheath Tube]

Figure 2:
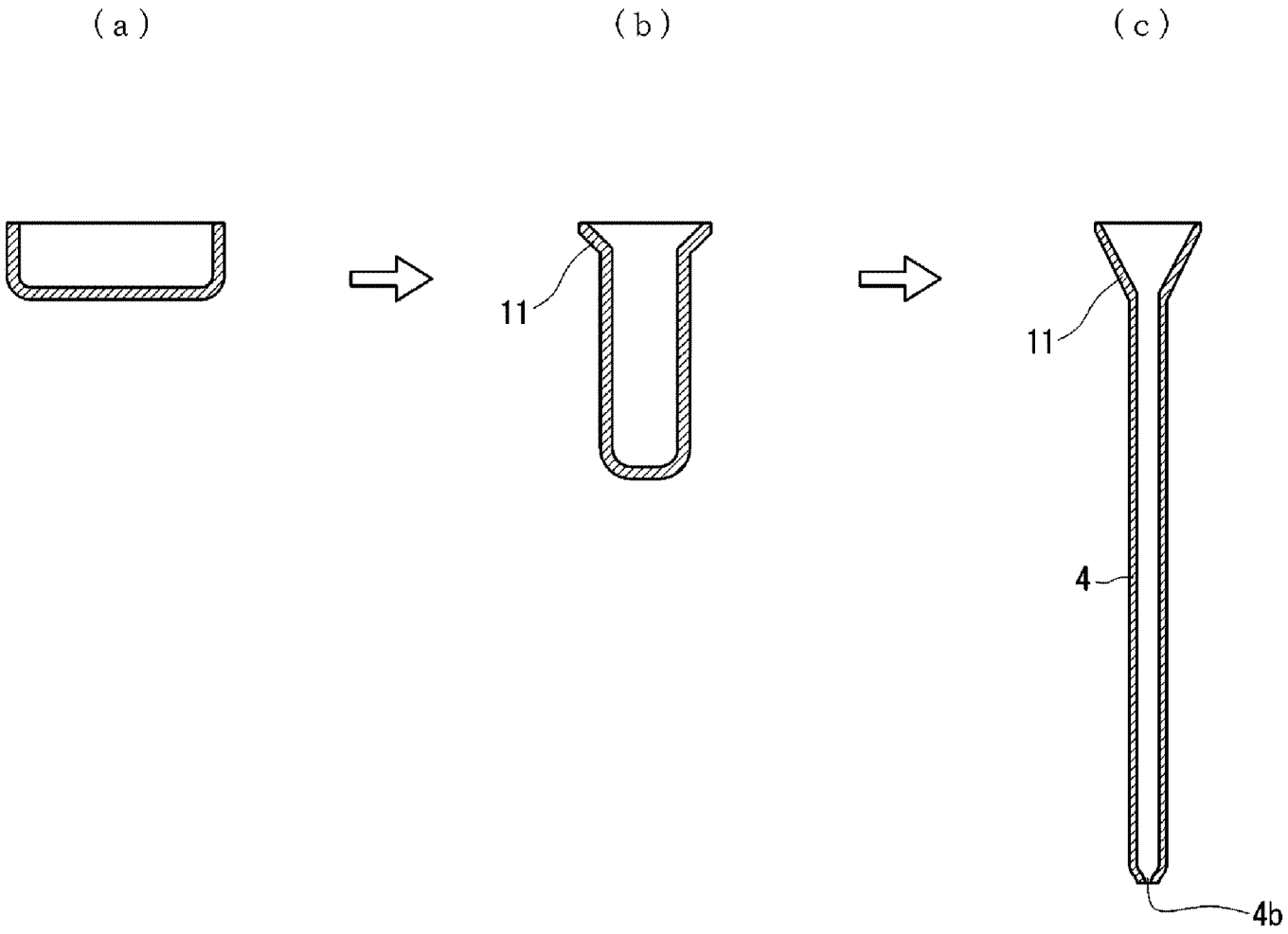
FIGS. 2(*a*) to 2(*c*) Cross-sectional views illustrating the step of forming a sheath tube.

To manufacture the sheath tube 4, a disk-shaped metal material punched from, for example, an Inconel steel plate is used as a starting material and subjected to a preform forming step in which the disk-shaped metal material is deep-drawn, as shown in FIGS. 2(*a*) to 2(*c*).

More specifically, the plate material used as the starting material is drawn into a closed-bottom tubular bowl shape with a diameter larger than its depth as shown in FIG. 2(*a*), further drawn into a closed-bottom tubular cup shape with a depth larger than the diameter as shown in FIG. 2(*b*), and still further drawn into a sheath tube shape shown in FIG. 2(*c*). During drawing, an enlarged-diameter portion 11 is integrally formed at the rear end of the cup shape as shown in FIG. 2(*b*). In the present embodiment, the enlarged-diameter portion 11 is formed into a tapered shape with a diameter gradually increasing toward the rear. As shown in FIG. 2(*c*), the through hole 4*b* is formed at the front end by punching. The step of punching the through hole 4*b* may be performed simultaneously with the preform forming step at the stage shown in FIG. 2(*c*), as in the present embodiment, or may be performed as an additional punching step after the preform forming step shown in FIG. 2(*c*).

Figure 10:
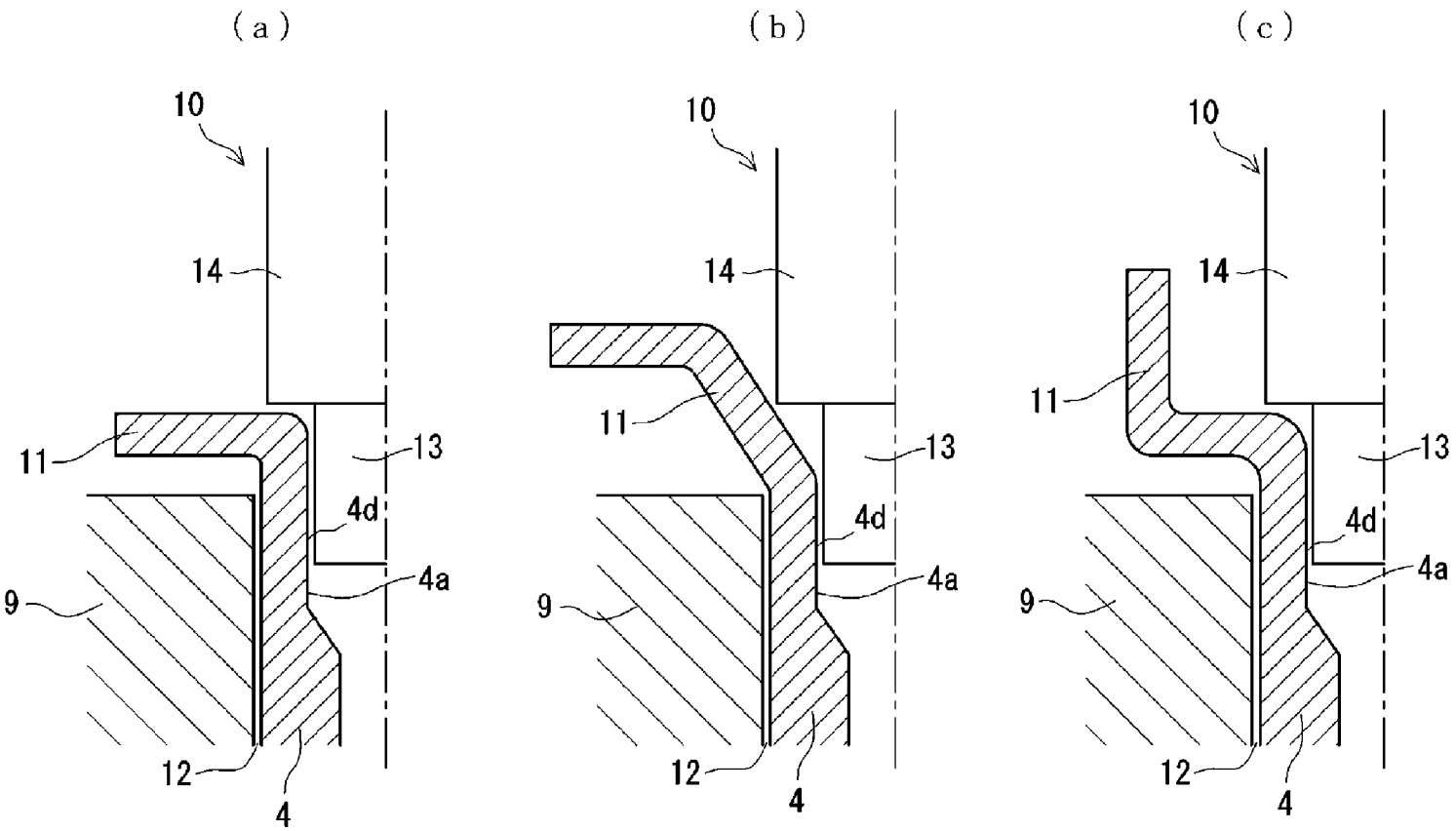
FIGS. 10(*a*) to 10(*c*) Enlarged cross-sectional views relating to modifications of the enlarged-diameter portion of the present invention and showing their essential parts.

FIGS. 2(*a*) to 2(*c*) exemplify part of the preform forming step, and a plurality of sub-steps are provided between the above stages, so that the starting material is gradually drawn deeper and deeper. In the preform forming step, the number of deep-drawing stages may be increased or decreased appropriately, or additional plastic working may be performed, whereby any of enlarged-diameter portions 11 having shapes shown in FIG. 10 can be appropriately employed.

As shown in FIG. 1, in the sheath tube 4 of the embodiment, the inner diameter of the seal portion 4*a* at the rear end is increased to form a thin-walled spot-faced portion (also referred to as a "thin-walled portion") 4*d* thinner than a main portion 4*c* occupying the longest region in the axial direction. The spot-faced portion 4*d* may be formed by additionally performing drawing using a die and a punch after the stage shown in FIG. 2(*c*). Of course, when a sheath tube 4 with no spot-faced portion 4*d* is manufactured, the preform forming step may be ended at the stage shown in FIG. 2(*c*). The work in process obtained as a result of ending the preform forming step (the work shown in FIG. 2(*c*) in the present embodiment) corresponds to a "tube preform" in the present invention.

Figure 3:
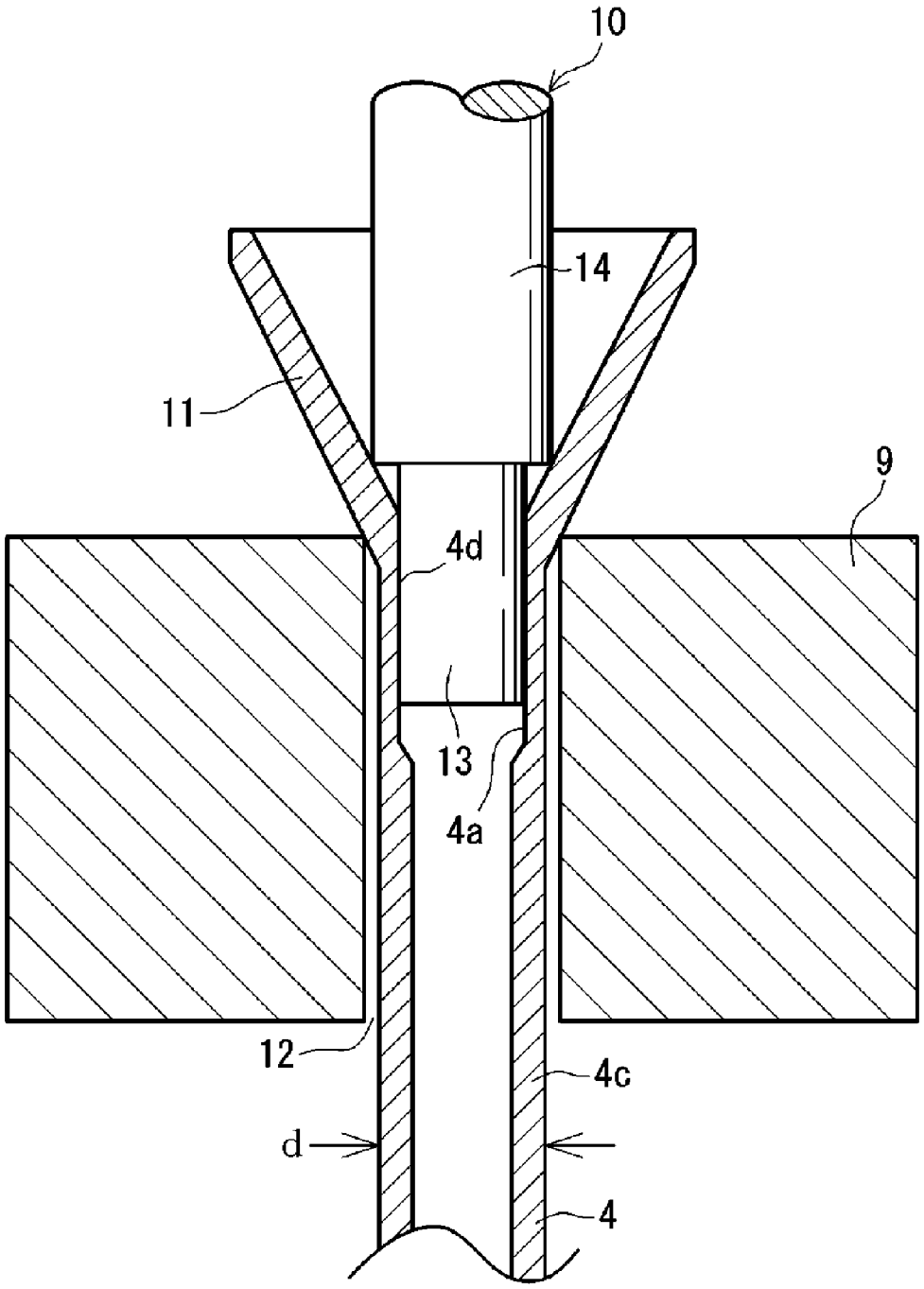
FIG. 3 An enlarged cross-sectional view illustrating an essential part immediately before an enlarged-diameter portion is sheared in a shearing step.
Figure 4:
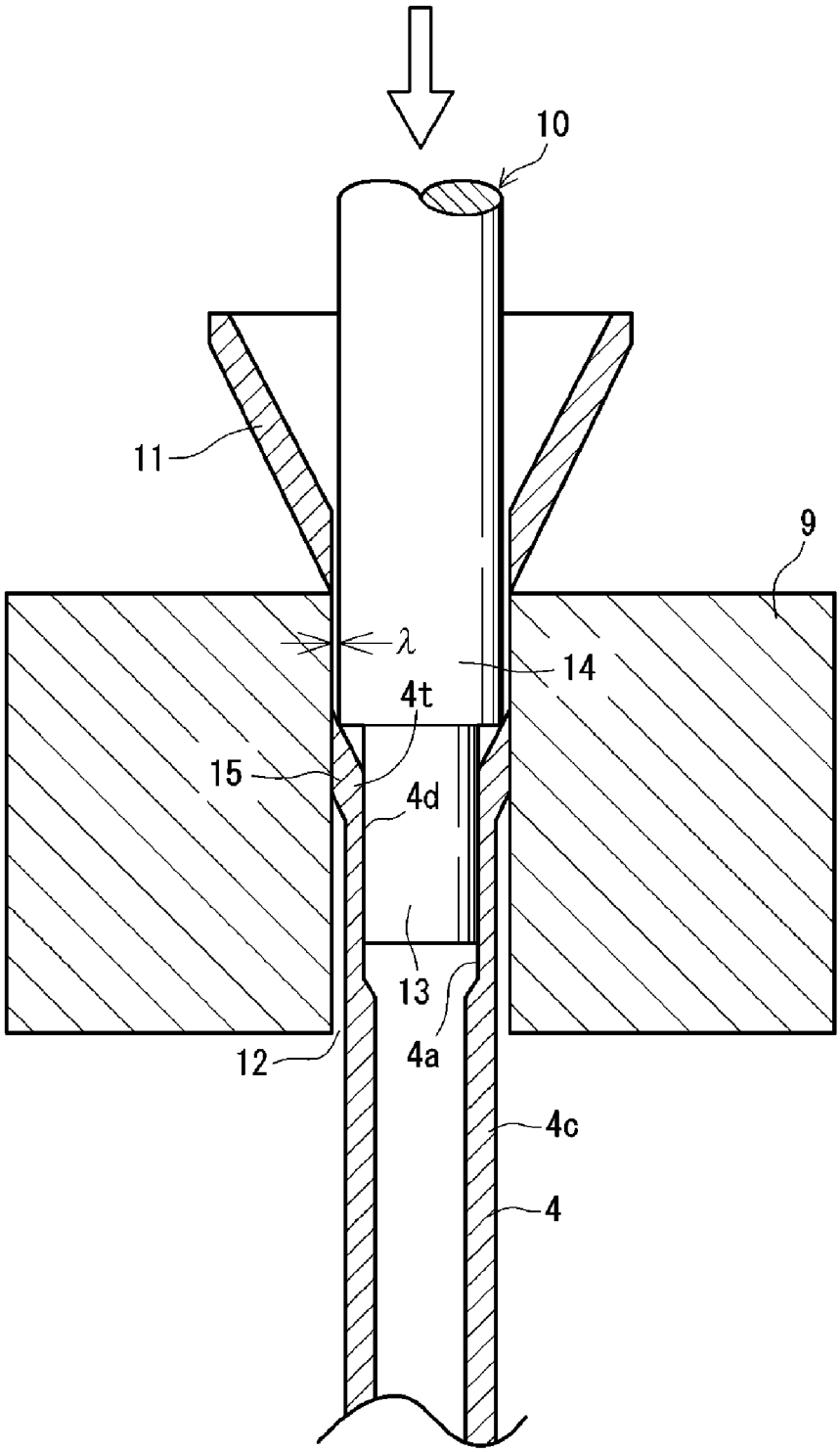
FIG. 4 An enlarged cross-sectional view illustrating the essential part immediately after the enlarged-diameter portion is sheared in the shearing step.

Next, in a shearing step shown in FIGS. 3 and 4, the enlarged-diameter portion 11 is separated and removed from the sheath tube 4 (tube preform) having the enlarged-diameter portion 11 formed in the preform forming step.

A die 9 used in the shearing step has a shearing hole 12 having an inner diameter slightly larger than the outer diameter d of the sheath tube 4, e.g., of about 1.01 d to about 1.02 d. A punch 10 has a front protruding shaft portion 13 to be inserted from the rear end of the sheath tube 4 and a shearing shaft portion 14 extending from the front protruding shaft portion 13. The shearing shaft portion 14 has an outer diameter larger than the outer diameter d of the sheath tube 4 and is smaller than the shearing hole 12, and an appropriate gap λ (see FIG. 4) is formed when the shearing shaft portion 14 enters the shearing hole 12 of the die 9. As described above, the die 9 is disposed externally of the outer circumference of the sheath tube 4 and radially externally of the enlarged-diameter portion 11. The punch 10 is disposed inside (inward of) the die 9 through the enlarged-diameter portion 11, in order to shear the enlarged-diameter portion 11 between the punch 10 and the die 9. The outer diameter d is the outer diameter of the main portion 4*c* of the sheath tube 4 having the enlarged-diameter portion 11 in the shearing step.

When the sheath tube 4 with the enlarged-diameter portion 11 is placed in the shearing hole 12 of the die 9, the enlarged-diameter portion 11 comes into contact with the shearing hole 12, and the sheath tube 4 is at rest. Then the punch 10 is lowered toward the sheath tube 4, and the front protruding shaft portion 13 is inserted into the rear end of the sheath tube 4, as shown in FIG. 3. The punch 10 is further pressed and moved downward. Then a large shear stress acts on the enlarged-diameter portion 11 held between the shearing hole 12 and the shearing shaft portion 14, and the enlarged-diameter portion 11 is finally separated and removed without generation of chips, as shown in FIGS. 4 and 5. Thus, a remaining portion 15 corresponding to the gap λ between the shearing hole 12 and the shearing shaft portion 14 remains at the rear end of the sheath tube 4 from which the enlarged-diameter portion 11 has been separated and removed, and a thick-walled portion 4*t* having a thickness larger than the thickness of the entire seal portion 4*a* is thereby formed. In FIG. 5, the rear edge of the sheath tube 4 is drawn as a simple acute shape, for the purpose of easy understanding of shearing. However, in reality, deformation such as curling occurs due to complicated stress applied during shearing, so that the shape shown in the figure is not obtained. However, it has been found in a trial production that a portion corresponding to the remaining portion 15 becomes the thick-walled portion 4*t* having a thickness larger than the thickness of the entire seal portion 4*a*. The sheath tube 4 can be manufactured such that almost no remaining portion 15 remains, but this depends on the material of the sheath tube 4, the settings of the outer diameters of the shearing hole 12 of the die 9 and the punch 10 used as working jigs, and the adjustment of the gap λ. It has also been found that, when the number of deep drawing stages is increased to form the enlarged-diameter portion 11 at a right angle as described above, the remaining portion 15 is formed into a shape slightly protruding in the radial direction accordingly.

[Method for Manufacturing Sheath Heater and Glow Plug]

A description will next be given of a method for manufacturing the sheath heater 2 and the glow plug 1 using the above sheath tube 4.

First, the lead 7 with the heating element 5 welded to the front end thereof is inserted, together with the heating element 5, into the sheath tube 4 from its rear end, and the front end 5*f* of the heating element 5 is inserted into the through hole 4*b* of the sheath tube 4 and welded thereto. The front end of the sheath tube 4 is closed by welding, and the sheath tube 4 is filled with the insulating powder 6. Next, as shown in FIG. 6(*a*), the seal member 8 is attached to the seal portion 4*a* from the rear end of the sheath tube 4. Then the sheath tube 4 is swaged to have a prescribed reduced diameter as shown in FIG. 6(*b*). During swaging, the portion to which the seal member 8 is attached is also swaged, so that the sheath tube 4 is hermetically sealed with the seal member 8.

In the sheath tube 4 of the present invention, the remaining portion 15 of the enlarged-diameter portion 11 is located on the outer circumference of the spot-faced portion 4*d* as described above, and this portion is the thick-walled portion 4*t* having a thickness larger than the thickness of the entire spot-faced portion 4*d*. Therefore, when the sheath tube 4 is deformed by swaging such that its outer diameter becomes uniform, the thick-walled portion 4*t* is deformed so as to protrude into the seal portion 4*a* and becomes the engagement projection 16 as shown in FIG. 6(*b*). Let the outer diameter of a portion of the seal member 8 that protrudes from the sheath tube 4 (the rear portion of the seal member 8) be ϕA. (see the enlarged view in FIG. 1, the same applies to the following), the outer diameter of the seal member 8 at the position where the engagement projection 16 is formed be ϕB, and the outer diameter of the portion fitted into the seal portion 4*a* (the front portion of the seal member 8) be ϕC. Then the relations ϕA>ϕB and ϕB<ϕC hold. In this case, the seal member 8 is tightened and constricted by the engagement projection 16. Therefore, the seal performance by the seal member 8 is improved, and almost no movement in a coming-off direction occurs.

For example, the outer diameter ϕB may be set to 45% to 95% of a larger one of ϕA and ϕC. This is for the following reasons. If the outer dimension ϕB exceeds 95%, the amount of projection of the engagement projection 16 is very small, so that the effect of preventing coming-off of the seal member 8 may not be obtained sufficiently. If the outer dimension ϕB is less than 45%, the seal member 8 may be damaged, and sufficient hermeticity may not be obtained.

When the outer diameter ϕA of the seal member 8 is assumed to be the actual outer diameter of the seal member 8, it is preferable that the above ϕA, ϕB, and ϕC satisfy ϕB<ϕC<ϕA. When the outer diameters of the portions of the seal member 8 satisfy this relation, the seal member 8 fitted in the seal portion 4*a* is elastically contracted and generates a repulsive force, and the repulsive force allows the seal member 8 to come into close contact with the inner circumference of the seal portion 4*a*, so that high hermeticity is achieved.

In another embodiment, the seal member 8 does not have a portion protruding outward from the sheath tube 4 (i.e., the rear portion, outer diameter: ϕA), as shown in an enlarged view in FIG. 6(*c*).

Preferably, the difference between the outer diameter ϕB at the formation position for the engagement projection 16 and the outer diameter ϕC of the front portion (ϕB−ϕC) is 0.1 mm or larger. When this relation holds, the seal member 8 is in close contact with the inner circumference of the seal portion 4*a*, and high hermeticity can be achieved.

A test was performed in order to examine the relation between the hermeticity and the difference (ϕB−ϕC) between the outer diameter ϕB at the position where the engagement projection 16 is formed and the outer diameter ϕC of the front portion. Seven sheath heaters (No. 1 to No. 7) having the same structure as that of the sheath heater 2 shown in FIG. 6(*b*) but different in the difference between ϕB and ϕC (ϕB−ϕC) were prepared. Each of the seven sheath heaters was disposed in a thermostatic chamber and held in an atmosphere of a temperature of 80° C. and a relative humidity of 90% for 30 minutes and then in an atmosphere of a temperature of −40° C. for 30 minutes. This thermal cycle was performed within 120 minutes and defined as one cycle of a thermal test. After every prescribed number of cycles of the thermal test, the sheath heater was removed from the thermostatic chamber, and an energization test was performed in which the sheath heater was energized for 2 minutes at a voltage at which the temperature of the sheath heater was saturated at 900° C. to 1,100° C. Before and after the energization test, the dimensions of parts of the sheath heater were measured using a micrometer. When a bulge of 0.1 mm or larger occurred, the sheath heater was determined to have bulged. When the number of cycles of the thermal test performed before the sheath heater was determined to have bulged was 1 to 100, the hermeticity of the sheath heater was determined to be "C". When the number of cycles of the thermal test performed before the sheath heater was determined to have bulged was 101 to 500, the hermeticity of the sheath heater was determined to be "B". When the sheath heater did not budge even after the number of cycles reached 1,000, the hermeticity of the sheath heater was determined to be "A". Table 1 shows the test results.

TABLE 1

| No. | ϕC-ϕB (mm) | Hermeticity determination results |
|---|---|---|
| 1 | 0 | C |
| 2 | 0.04 | B |
| 3 | 0.06 | B |
| 4 | 0.08 | B |
| 5 | 0.1 | A |
| 6 | 0.16 | A |
| 7 | 0.2 | A |

As can be seen from Table 1, the hermeticity of sheath heater No. 1, i.e., a sheath heater with no engagement projection, was determined to be "C"; i.e., was not good. However, the hermeticity of each of the sheath heaters with engagement projections (Nos. 2 to 7) was determined to be "A" or "B". Therefore, it was found that the sheath heaters with engagement projections (Nos. 2 to 7) had higher hermeticity than that of the sheath heater with no engagement projection (No. 1). Particularly, the hermeticity of each of sheath heaters Nos. 5 to 7, i.e., sheath heaters in which the difference between ϕC and ϕB (ϕC−ϕB) was 0.1 mm or larger (ϕC−ϕB)≥0.1 mm) was determined to be "A". Therefore, it was found that high hermeticity can be achieved.

In order to prevent formation of a short circuit between the sheath tube 4 and the lead 7, the outer diameter ϕD of the lead 7 at the position where the seal member 8 is disposed is preferably set such that the difference between ϕC and ϕB (ϕC−ϕB (unit: mm)) is smaller than a value obtained by subtracting 1 mm from the difference between ϕC and ϕD ((ϕC−ϕD)−1 (unit: mm)) (i.e., ϕC−ϕB<(ϕC−ϕD)−1 (unit: mm)).

Preferably, the ratio of swaging when the sheath tube 4 is swaged (the ratio of the cross-sectional area of the sheath tube 4 in a direction perpendicular to the axial direction after swaging to the cross-sectional area of the sheath tube 4 in the direction perpendicular to the axial direction before swaging) is set to 30% to 80%. Through setting the swaging ratio as described above, coupled with formation of the engagement projection 16 on the sheath tube 4, the seal member 8 can exhibit excellent seal performance.

In the sheath heater manufactured as described above, the seal portion 4*a* is formed so as to have a substantially uniform outer diameter, and therefore the effect of improving sealing performance, the effect of enhancing easiness of press-fitting, the effect of facilitating diameter reducing work, etc. are achieved. This is advantageous mainly in the manufacturing process. Specifically, for example, it is not necessary to form the rear end of the sheath tube into a stepped shape, and a problem in that, when the sheath heater is press-fitted into the metallic shell 3, a step formed on the outer periphery is caught by a press-fitting portion of the metallic shell 3 is unlikely to occur. This leads to an improvement in the sealing properties of the sheath heater.

The sheath heater 2 manufactured as described above is press-fitted into the metallic shell 3 such that the front end of the sheath tube 4 protrudes toward the outside of the metallic shell 3, whereby the glow plug 1 is manufactured.

Figure 7:
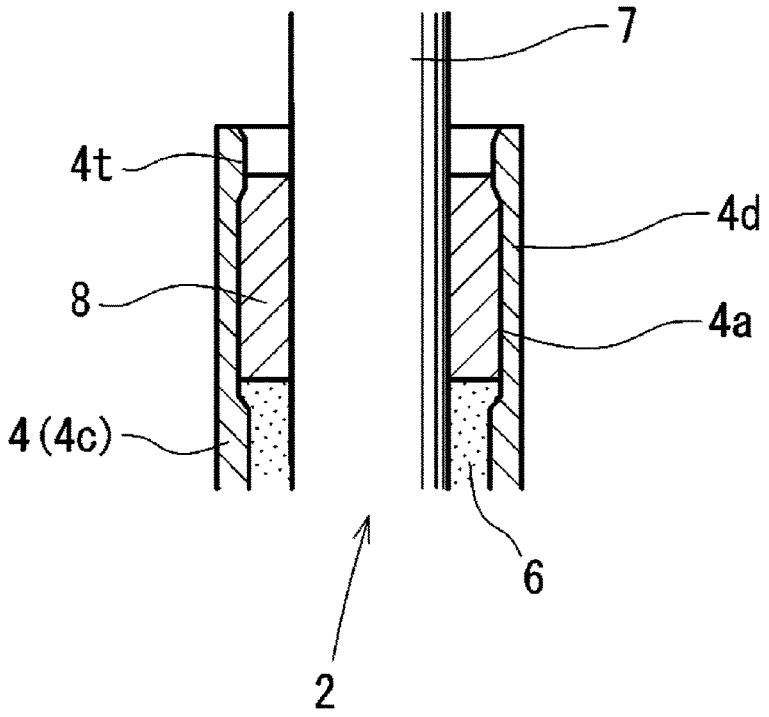
FIG. 7 A cross-sectional view of an essential part of the sheath heater before swaging, the view showing another form of a thick-walled portion.
Figure 8:
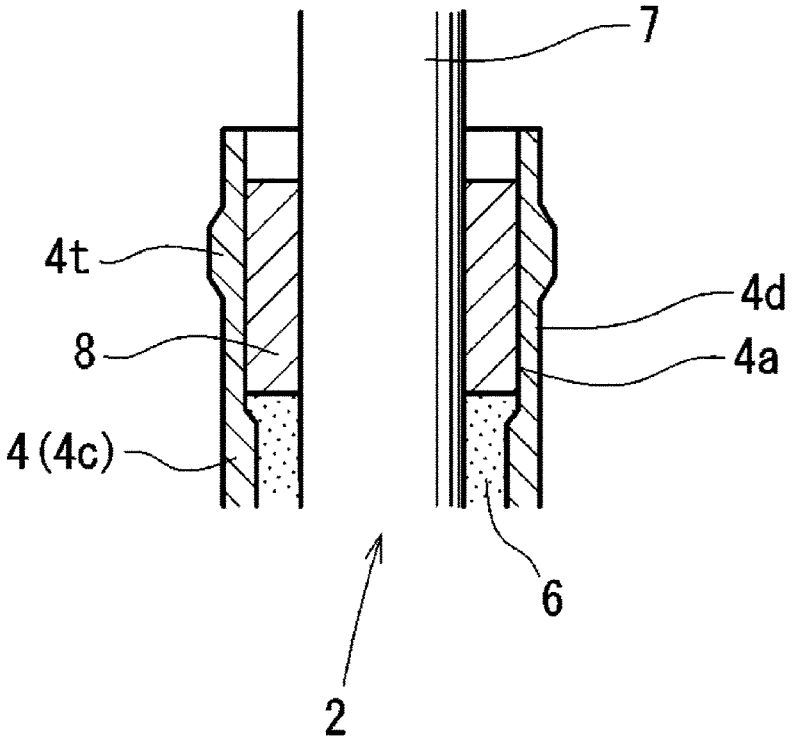
FIG. 8 A cross-sectional view of an essential part of the sheath heater before swaging, the view showing another form of a thick-walled portion.
Figure 9:
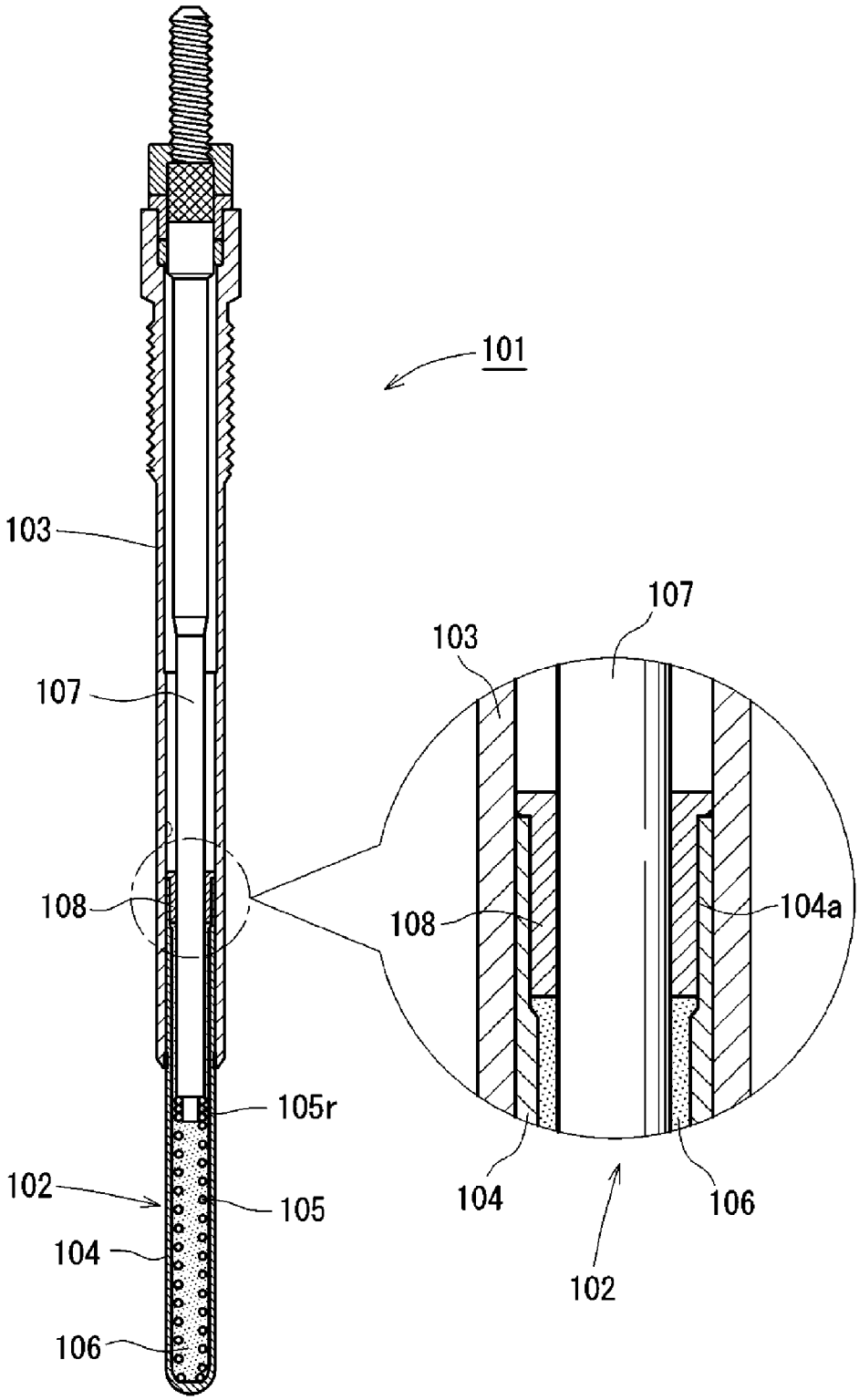
FIG. 9 A vertical cross-sectional view illustrating a conventional glow plug.

The embodiments of the present invention have been described above. Of course, the present invention is not limited to the above-described embodiments. For example, in the embodiments, the thick-walled portion 4*t* is formed with the protruding annular remaining portion 15 remaining on the outer circumference of the rearmost end of the sheath tube 4. However, the thick-walled portion 4*t* may be formed radially inwardly on the inner circumference of the upper end of the seal portion 4*a* as shown in FIG. 7 or may be formed annularly on the outer circumference of an intermediate portion of the seal portion 4*a* as shown in FIG. 8. Alternatively, the thick-walled portion 4*t* may not be formed into an annular shape but may be formed into a circumferentially discontinuous shape. As described above, the shape of the thick-walled portion 4*t* may be modified variously so long as the modification does not exceed the scope of the present invention. The method for forming the thick-walled portion 4*t* is not limited to deep-drawing used in the above embodiments, and the thick-walled portion 4*t* may be formed by upsetting the rear end of the sheath tube 4 to cause the rear end to protrude outward or may be formed by cutting.

Figure 11:
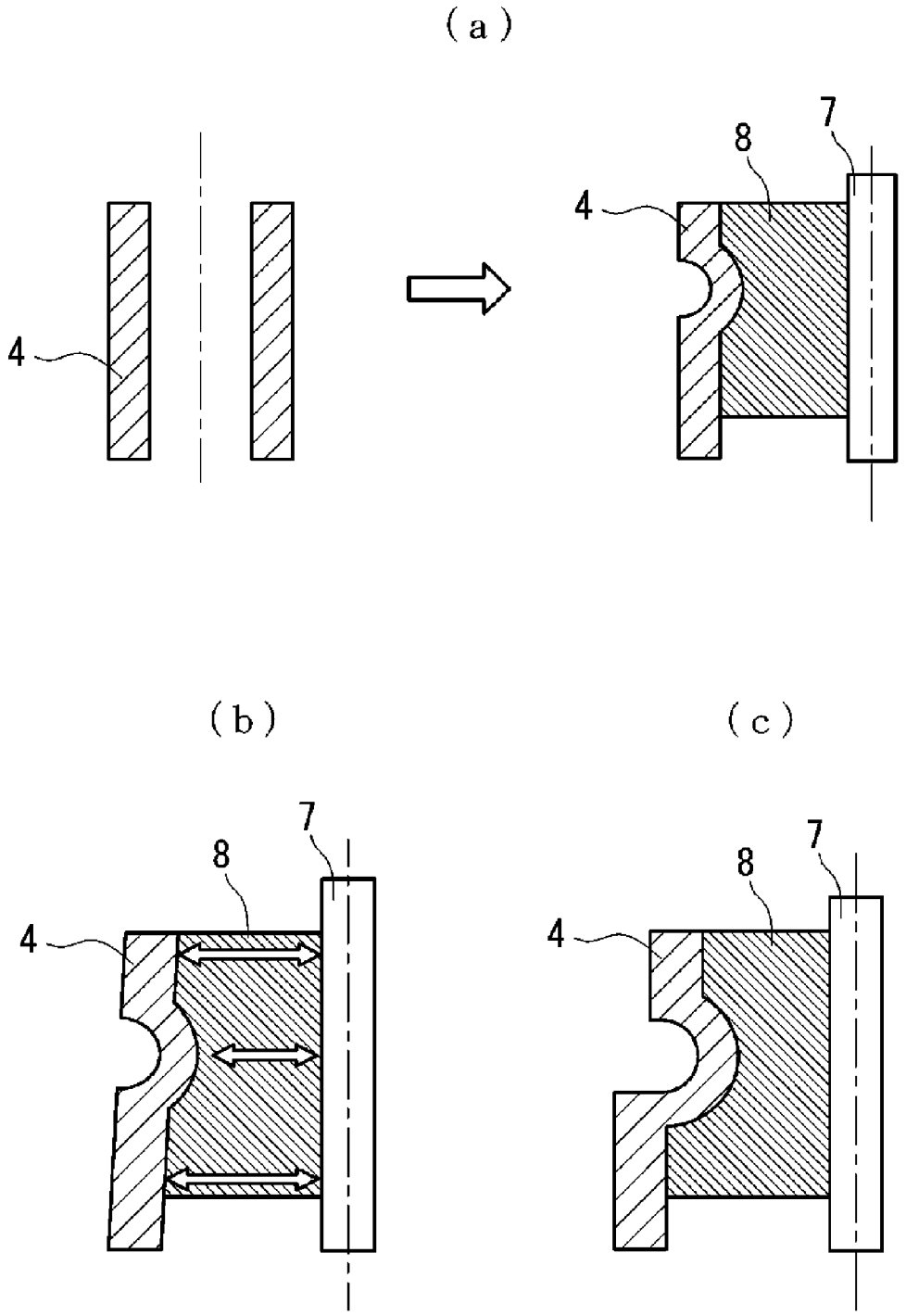
FIGS. 11(*a*) to 11(*c*) Enlarged cross-sectional views illustrating an essential part of a related reference example.

A reference example relating to the idea of the present invention is exemplified in FIGS. 11(*a*) to 11(*c*).

Generally, the seal portion 4*a* is reduced in diameter using a swaging machine. Crimping with a crimping blade shorter than the axial length of the seal member 8 may be additionally or independently performed to form the engagement projection 16 such that the engagement projection 16 protrudes radially inwardly. In this case, the effect of suppressing the movement of the seal member 8 in a coming-off direction can be obtained (FIGS. 11(*a*) to 11(*c*)). However, when the engagement projection 16 is formed in the manner described above, a crimping mark formed by the crimping blade remains on the outer circumferential surface of the seal portion 4*a*, so that the seal portion 4*a* is not formed to have a uniform diameter.

DESCRIPTION OF REFERENCE NUMERALS

1: glow plug
4: sheath tube
4*a*: seal portion
4*t*: thick-walled portion
5: heating element
6: insulating powder
7: lead
8: seal member
9: die
10: punch
11: enlarged-diameter portion
16: engagement projection
ϕA: outer diameter of the rear portion of the seal member
ϕB: outer diameter of the seal member at the position where the engagement projection is formed
ϕC: outer diameter of the front portion of the seal member

The invention claimed is:

1. A glow plug comprising:
- a sheath tube which is formed of a metal and which extends in an axial direction and has a closed front end;
- a heating element accommodated within the sheath tube;
- insulating powder which fills an interior of the sheath tube so as to surround the heating element;
- a rod-shaped lead which is formed of a metal and which is connected to the heating element and inserted into the sheath tube from a rear end of the sheath tube; and
- a seal member which is located in a seal portion of the sheath tube formed at the rear end of the sheath tube and which hermetically seals a gap between the sheath tube and the lead;
- wherein the sheath tube is formed to have a substantially uniform outer diameter over an axial range including and extending beyond a range where the seal portion is formed,
- wherein the seal portion includes a spot-faced portion, an inner diameter of the spot-faced portion being larger than a remainder of the sheath tube,
- wherein the seal member is disposed rearward with respect to a front end of the spot-faced portion,
- wherein the sheath tube has an engagement projection formed at the seal portion and deformed so as to protrude radially inwardly, and
- wherein a thickness of the engagement projection when viewed in a cross-section taken in a direction perpendicular to an outer wall of the sheath tube at the engagement projection is greater than a thickness of an entire remainder of the seal portion of the sheath tube when viewed in a cross-section taken in a direction perpendicular to an outer wall of the sheath tube outside of the engagement projection.

2. A glow plug according to claim 1, wherein at least one of an outer diameter ϕA of a rear portion of the seal member located rearward of a position where the engagement projection of the sheath tube is formed and an outer diameter ϕC of a front portion of the seal member located frontward of the position is larger than an outer diameter ϕB of the seal member at the position.

3. A glow plug according to claim 2, wherein a difference between the outer diameter ϕC of the front portion and the outer diameter ϕB of the seal member at the position where the engagement projection is formed is 0.1 mm or larger.

4. A method for manufacturing a glow plug including a sheath tube which is formed of a metal and which extends in an axial direction and has a closed front end;
- a heating element accommodated within the sheath tube;
- insulating powder which fills an interior of the sheath tube so as to surround the heating element;
- a rod-shaped lead which is formed of a metal and which is connected to the heating element and inserted into the sheath tube from a rear end of the sheath tube; and
- a seal member which is located in a seal portion of the sheath tube formed at the rear end of the sheath tube and which hermetically seals a gap between the sheath tube and the lead;

the method comprising forming a spot-faced portion within a part of the seal portion, whereby an inner diameter of the spot-faced portion is increased relative to a remainder of the sheath tube;

forming a thick-walled portion of the sheath tube, the thick-walled portion being located on the outer circumference of the spot-faced portion and having a thickness larger than a thickness of the entire spot-faced portion;

placing the heating element, the lead, and the insulating powder in the sheath tube, and thereafter disposing the seal member rearward with respect to a front end of the spot-faced portion; and deforming the seal portion by a force applied to an outer circumference of the seal portion, whereby the thick-walled portion forms an engagement projection that is deformed so as to protrude radially inwardly; and wherein a thickness of the engagement projection when viewed in a cross-section taken in a direction perpendicular to an outer wall of the sheath tube at the engagement projection is greater than a thickness of an entire remainder of the seal portion of the sheath tube when viewed in a cross-section taken in a direction perpendicular to an outer wall of the sheath tube outside of the engagement projection.

5. A method for manufacturing a glow plug according to claim 4, wherein the thick-walled portion protrudes from the outer circumference of the seal portion.

6. A method for manufacturing a glow plug according to claim 4, wherein the thick-walled portion is formed at a rear axial end of the seal portion.

7. A method for manufacturing a glow plug according to claim 4, wherein the sheath tube is formed by at least:

a preform forming step of forming a tube preform having a cylindrical tubular main portion and an enlarged-diameter portion which is located rearward of the main portion, has a diameter larger than an outer diameter of a rear end of the main portion, and is radially expanded; and a shearing step of separating and removing the enlarged-diameter portion by a shearing force by inserting the main portion of the tube preform into a shearing hole of a die, the shearing hole having an inner diameter at least equal to or larger than the outer diameter of the main portion, such that the enlarged-diameter portion is supported by a rear end of the shearing hole of the die, and moving a punch disposed radially inward of the enlarged-diameter portion toward the die coaxially with the shearing hole in order to produce the shearing force; and wherein the thick-walled portion of the sheath tube is a remaining portion of the enlarged-diameter portion remaining after the shearing step.

8. A method for manufacturing a glow plug according to claim 7, wherein the enlarged-diameter portion is separated and removed in the shearing step in a region where the diameter of the enlarged-diameter portion gradually increases rearward from the main portion.

9. A method for manufacturing a glow plug according to claim 7, wherein the enlarged-diameter portion is formed by plastic working.

10. A method for manufacturing a glow plug according to claim 7, wherein the main portion and the enlarged-diameter portion of the tube preform are formed from a plate-shaped metal material by deep-drawing.

11. A method for manufacturing a glow plug according to claim 7, wherein the tube preform for the sheath tube has a through-hole formed at a front end of the tube preform before welding of the heating element, and the through-hole is closed by welding of the heating element, and the method further comprises a hole forming step of, during the preform forming step or after the preform forming step, forming the through-hall by punching.

* * * * *